US006497179B1

(12) United States Patent
Allen et al.

(10) Patent No.: US 6,497,179 B1
(45) Date of Patent: Dec. 24, 2002

(54) METHOD AND APPARATUS FOR DISTINGUISHING TRANSPARENT MEDIA

(75) Inventors: Ross R. Allen, Belmont, CA (US); Carl E Picciotto, Menlo Park, CA (US); Jun Gao, Mountain View, CA (US)

(73) Assignee: Hewlett Packard Company, Palo Alto, CA (US)

( * ) Notice: Subject to any disclaimer, the term of this patent is extended or adjusted under 35 U.S.C. 154(b) by 0 days.

(21) Appl. No.: 09/909,710

(22) Filed: Jul. 19, 2001

(51) Int. Cl.[7] ..... B41F 1/54
(52) U.S. Cl. ..... 101/484
(58) Field of Search ..... 101/484, 483, 101/211, 171; 347/262

(56) References Cited

U.S. PATENT DOCUMENTS 5,401,977 A 3/1995 Schwarz
5,925,889 A 7/1999 Guillory et al.
6,006,668 A 12/1999 Rehmann
6,088,116 A 7/2000 Pfanstiehl
6,233,053 B1 5/2001 Preston et al.

*Primary Examiner*—Raquel Yvette Gordon

(57) ABSTRACT

A printer having a transparency film discrimination system is disclosed. The printer includes a feed mechanism, an illumination source, a detector, and a processor. Light from the illumination source is reflected on or transmitting through the print medium (such as a transparent film) and is detected by the detector. The detected light is analyzed to determine the type of the medium. If the determined type of the print medium is not acceptable for the printer, then control signal is provided to the printer to halt the printing process as to avoid damage to the printer.

21 Claims, 3 Drawing Sheets

METHOD AND APPARATUS FOR DISTINGUISHING TRANSPARENT MEDIA

BACKGROUND

The present invention relates to printing devices and systems. More particularly, the present invention relates to method of and detector for distinguishing different transparency media types for a printer.

Overhead projection devices commonly use printed transparent films or sheets ("transparencies") to project information onto a projection screen. The transparencies are often printed using laser printers or inkjet printers. However, different types of transparencies are used for the different type of printers. This is because the laser printers and the inkjet printers use different techniques and materials for the print operation, thus requiring different properties from the transparency media.

Laser printers electrostatically deposit toner on a medium, and then fuse the toner onto the medium by applying pressure and heat to the medium having the toner deposits. The pressure and the heat are applied using a fuser. The fuser may reach temperatures of 150 degrees Celsius or more. Because the toner is electrostatically deposited and pressure-heat fused, a first type of transparencies ("laser transparencies") are typically made of clear plastic (such as MYLAR®) substrate having smooth printing surface.

Inkjet printers require a different type of transparencies ("inkjet transparencies") because no fuser is used. The inkjet printer shoots tiny drops of ink onto the medium. The medium receives and retains the ink. Accordingly, an inkjet transparency includes an ink-receptive surface layer (such as gelatin or other materials) coated on a clear plastic substrate.

Although an inkjet transparency may have a rougher surface than surfaces of a laser transparency, the two types of transparencies are often difficult to distinguish. Further, many people are not even aware that an inkjet transparency should not be fed into certain types of laser printers. This is because the ink-receptive surface layer of the inkjet transparency melts from the fuser's heat and sticks to the fuser. This requires a replacement of the fuser, which is a relatively expensive portion of the laser printer.

Accordingly, there is a need for a method and apparatus to recognize or prevent the feeding of inkjet transparencies into a laser printer.

SUMMARY

These needs are met by the present invention. According to a first aspect of the present invention, a printer has a transparency film discrimination system including a feed mechanism for feeding a print medium toward a print mechanisms, the print medium being one of a plurality of different types, each type having a print surface. The printer also includes an illumination source for providing light to impinge on the print surface and a detector for detecting one of reflected and transmitted light from the print surface to provide a detection signal representing the print surface so as to allow identification of transparency type of the print medium. Further, the printer has a processor for applying metric criteria to the detected signal to identify type of transparency of the print medium and for providing control to the print mechanism dependent on the identified transparency type so that damage to the printer is avoided.

According to a second aspect of the invention, a method of operating a printer is disclosed. First, a print medium is fed toward a print mechanism, the print medium being one of a plurality of different types, each type having a print surface. Then, the print surface of the print medium is illuminated. Next, one of reflected and transmitted light from the print surface is detected to provide a detection signal representing the print surface so as to allow identification of transparency type of the print medium. Finally, metric criteria are applied to the detected signal to identify type of transparency of the print medium and for providing control to the print mechanism dependent on the identified transparency type so that damage to the printer is avoided.

According to a third aspect of the invention, a printer having a transparency film discrimination system is disclosed. The printer has a feed mechanism for feeding, to a print mechanism, a transparency film medium having a print surface and a first illumination source for providing light to transmit through the print medium. Moreover, the printer includes a detector for detecting the transmitted light for providing a detection signal to a processor. The processor is connected to the detector and to the feed mechanism and is programmed to apply a metric criteria to the detected signal to determine whether the print medium is of an acceptable type, and to signal the feed mechanism to reject print media of unacceptable type to prevent damage to the print mechanism.

Other aspects and advantages of the present invention will become apparent from the following detailed description, taken in conjunction with the accompanying drawings, illustrating by way of example the principles of the invention.

DETAILED DESCRIPTION

Figure 1:
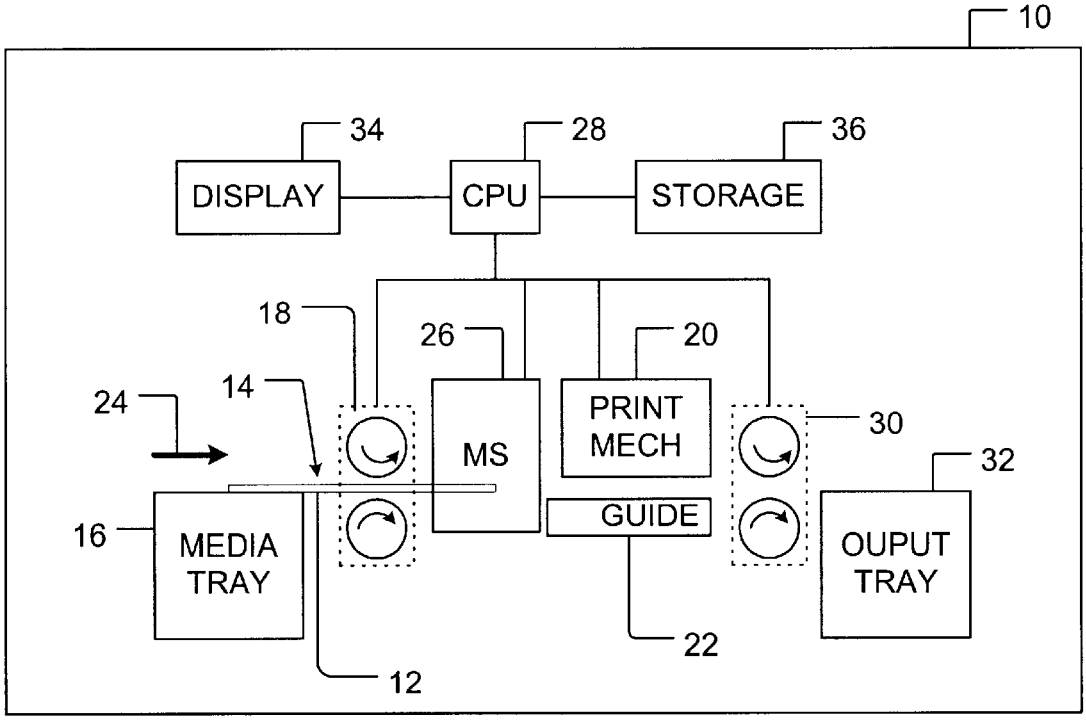
FIG. 1 illustrates an apparatus including one embodiment of the present invention.

As shown in the drawings for purposes of illustration, the present invention is embodied in a printer having transparency distinction system. The transparency distinction system includes a feed mechanism for feeding a transparency (having a print surface) toward a print mechanism. During the transparency feed, and before it reaches the print mechanism, light from a light source is reflected on the print surface, and the reflected light provides illumination to impinge on the print surface for reflection. The reflected light is detected and analyzed using predefined criteria. Alternative to the reflected light, transmitted light may be used for a similar effect.

If the criteria is not met, then a processor signals the feed mechanism to stop the feed, thereby preventing feeding of a wrong type of transparency to the print mechanism, thereby preventing damage to the fuser.

Referring to FIG. 1, a printer 10 is shown for printing on a print medium 12, for example a transparency sheet, having a print surface 14. The sheet 12 is typically fed from a media tray 14 by a feed mechanism 18 toward a print mechanism 20. The print mechanism 20 typically includes a fuser (not shown) in a laser printer. The sheet 12 is directed toward the print mechanism by a guide 22. Directed line 24 indicates direction of travel of the sheet 12.

In one embodiment of the present invention, a media sensing system 26 is positioned such that the sheet 12 traverses across the media sensing system 26 before reaching the print mechanism 20. The media sensing system 26, along with the feed mechanism 18 and other components of the printer 10 may also be referred to as a transparency film discrimination system.

The media sensing system 26 senses the media (as further explained herein below) and provides a detected signal to a processor 28. The processor 28 is connected to the media sensing system 26, the feed mechanism 18, the print mechanism 20, and an output mechanism 20. The processor 28 may be a separate processor or the printer's embedded controller running a program that accomplishes the media sensing and feed path control functions discussed herein. The processor 28 applies one or more metric criteria to the detected signal from the media sensing system 26 to determine whether the print medium 12 is of an acceptable type. If the sheet 12 is an acceptable type, then the processor 28 allows the sheet 12 to continue to travel to the print mechanism 20 for printing. Then, the sheet 12 is taken by the output mechanism 30 toward an output tray 32.

If the sheet 12 is not of an acceptable type, then the processor 28 signals the feed mechanism 18 to halt. Alternatively, the processor 28 may signal the print mechanism to prevent activation of the fuser or the printing processes. Further, the processor 28 may cause a display screen 34 to display an error or a service message.

Figure 2A:
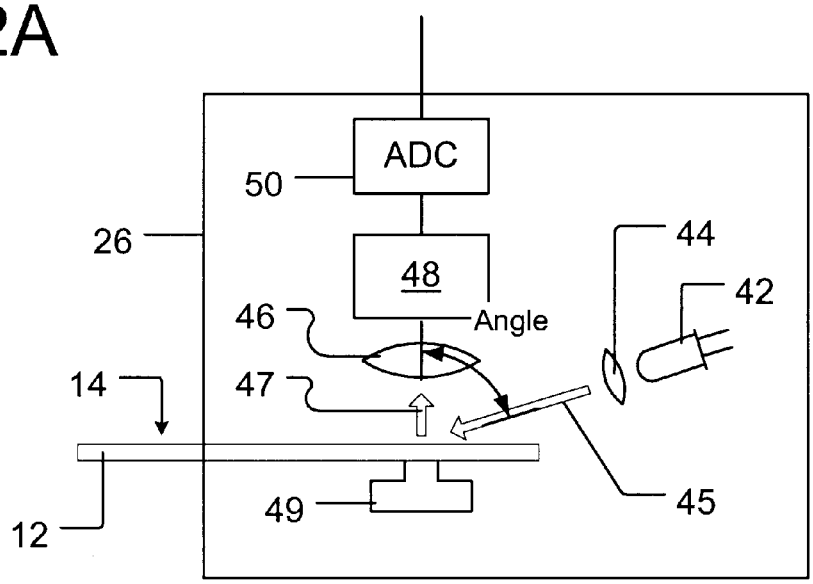
FIGS. 2A and 2B illustrate alternative embodiment of a media sensing system of the present invention.

FIG. 2A illustrates the media sensing system 26 of FIG. 1 in more detail. The media sensing system 26 includes a light source 42 for providing illumination of the media surface 12. The source 42 can be a light emitting diode (LED). The light from the source 42 is illustrated by a directed ray 45. The light 45 from the source 42 may be filtered, collimated, or altered by source optics 44. The light 45 impinges the surface 14 of the sheet 12 at an angle ranging typically between 0 and 75 degrees with respect to the normal from the media surface 14. To highlight distinctive features of transparencies, especially relatively more feature rich inkjet transparencies, the angle may be 45 degrees or more.

In the illustrated embodiment, light ray 45 impinges the surface 14 of the sheet 12 and reflects toward a sensor 48. The reflected light is illustrated as directed ray 47 and may be filtered, collimated, magnified, or altered by sensor optics 46 before being detected by the sensor 48. The sensor optics 46 and the size of the sensor 48 define a field of view and size of the area on the media surface 14 scanned. Light 45 that passes through the sheet 12 is trapped by a black tile 49. Illustrated rays 45 and 47 are used only to indicate a general direction of the light and not intended to represent ray traces as used in optical arts.

Further, additional light sources (not shown) may be included in the sensing system 26 providing multiple sources of light and varying angles and using varying wavelength radiation. Likewise, additional sensors (not shown) and corresponding sensor optics may be used to detect the reflected light at multiple areas of the medium 12, at multiple angles, or both.

Figure 2B:
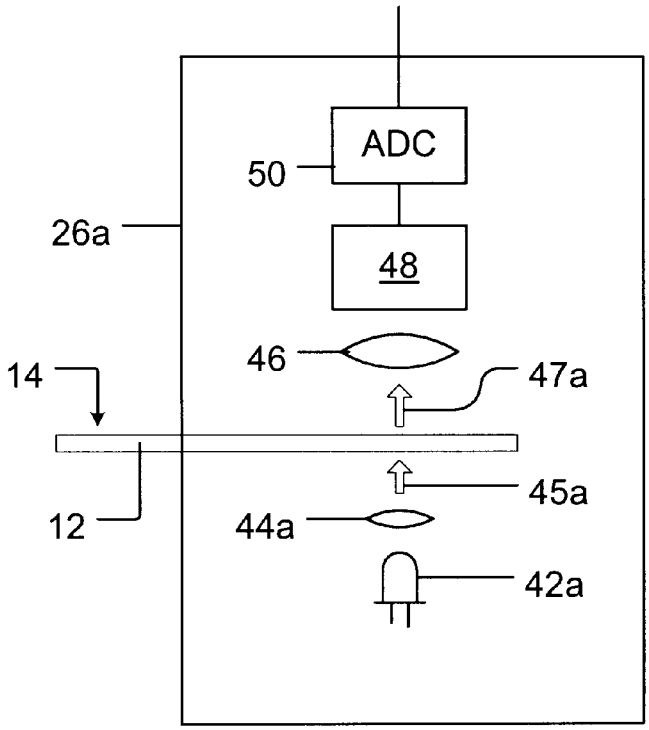

FIG. 2B illustrates an alternative embodiment of the sensing system 26*a* of the present invention. The sensing system 26*a* includes an alternate configuration of the present invention including portions that are similar to those shown in FIG. 2A. For convenience, components in FIG. 2B that are similar to components in FIG. 2A are assigned the same reference numerals, analogous but changed components are assigned the same reference numerals accompanied by letter "a", and different components are assigned different reference numerals.

In the sensing system 26, illuminating light 45*a* from the light source 42*a* is transmitted through the medium 12. The light may be filtered, collimated, or altered by source optics 44*a*. The sensor optics 46 may focus the transmitted light 47*a* on the sensor 48 which detects the transmitted light 47*a*. Here, the black cavity 49 of FIG. 2A is not necessary.

Although the source light 45*a* is illustrated as being normal to the surface 14 of the medium 12, the angle at which the source light 45*a* is introduced to the medium 12 may vary. Again, the sensor optics 46 and the size of the sensor 48 define a field of view and size of the scan area on the media surface 14. In another embodiment, the transmitted light 47*a* and the reflected light 47 of FIG. 2A may be combined in one sensing system 26.

The sensor 48 may be a sensor array such as a CCD (charge coupled device) or a CMOS (complementary metal oxide semiconductor) sensor array. Such sensor arrays are known in the art. Alternatively, the sensor 48 may be a single pixel imager such as a simple phototransistor or an integrated light-to-voltage or light-to-frequency converted. Such devices are known in the art. In one embodiment, the sensor 48 has a rectangular field of view of about 10 to 50 microns along media feed direction 24 by about 500 microns along the cross feed direction. Similarly, transmission sensor 48 may have a similar field of view.

Transparency films are designed to transmit light from an illumination source below the film to projection optics in overhead projectors known in the art. These films have, therefore, few surface features for scattering light. Nevertheless, detectable surface features do exist as a byproduct of manufacturing and from the design of the material and coatings. Due to the sparseness of surface features in transparency sheets of both types (laser and inkjet types), the reflected and transmitted light signals are typically monitored as the sheet 12 moves continuously through their field of view. The optical and illumination design provides an optical window through which surface features pass and can be detected. A single "snapshot" may not have a sufficient number of features characteristic of a particular media to provide reliable detection.

Some sensors such as a CMOS image sensor have integrated digital output signals. However, other sensors have analog outputs that may require conversion to a digital signal using an external analog to digital converter (ADC) 50 of FIG. 1. Devices that directly convert light into frequency provide their own ADC function.

Figure 3:
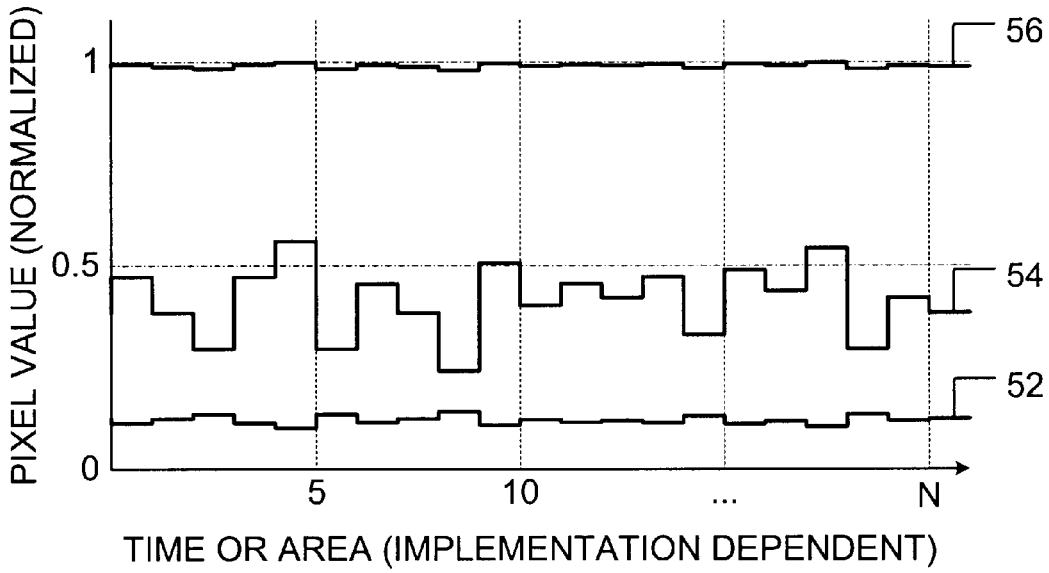
FIG. 3 illustrates sample sensor values of print media.

Referring again to FIG. 1, the digital signal, representing the detected light, from the ADC 50 is transmitted to the processor 28 for analysis. FIG. 3 illustrates three sample signals received by the processor 28. Detected signal 52 may represent signals received by the processor for laser transparencies. In FIG. 3, the y-axis represents normalized pixel gray values. Before normalization, the pixel values may range from, for example, 0 to 255 for an 8-bit representation. In this case, the illumination and sensitivity are designed so that, for example, zero represents the expected brightest value and 255 the expected darkest value so that all pixel values are within an 8-bit range. The x-axis relates to the area scanned in arbitrary units, typically related to time (or position on the surface of the sheet along the feed direction). As already discussed, in one embodiment, the area scanned is in the range of 50 microns high by about 500 microns wide.

As sheet 12 passes under the sensor, illuminated scattering sites on the surface and in the coating layer of the transparency pass through the scanned area. The size of the imaging area, the magnification of the optics, and the illumination are arranged to detect scattering and absorption sites which allows the sensor or sensors to operate by detecting the microstructure of the transparency surface and coating layer. The scattering and absorption of light by these microscopic sites modulates the quantity of light received by the sensor or sensors. This modulation produces a signal of sufficient variability to be analyzed to discriminate between types of transparency film and paper.

For the present sample embodiment, detection of surface features in the range of 5 to 50 microns is achieved by suitable design of the sensor 48, illumination 42 and 42*a,* and optics 46. These surface features absorb or scatter the incident light 45 producing modulation of the reflected and transmitted light which is detected and analyzed. The sample slit size of 50 by 500 microns allows the surface features (of the stated size for example) to be analyzed by the sensor 48 when the features are sparsely and randomly distributed.

The normalized pixel values of the laser transparency reflected signal 52 has a low average and variance because the laser transparency is relatively featureless and allows almost all light 45 to pass through the transparency. Further, it allows only a small portion of the light 45 to be reflected to the sensor 48. Variance is low because the surface of the laser transparency is relatively uniform. The transmitted signal curve (not shown) has similar dynamic characteristics although its average value and variance may be different from the reflected signal.

Signal 54 represents a sample detected signal received when the sheet 12 is an inkjet transparency. In this example, the inkjet transparency signal 54 has normalized pixel values and a variance higher than those of the laser transparency signal 52 because an inkjet transparency typically exhibits more features in the coating layer to scatter and absorb light. Yet, a majority of the light 45 still passes through the inkjet transparency. The signal characteristics of the transmitted signal has similar dynamic characteristics to the reflected signal, but because more light is scattered from the surface features, the value of the variations may be larger. For this reason, transmitted light may be preferable for some implementations. In addition, the inkjet transparency signal 54 has more range, or variance, than that of the laser transparency signal 52 because the surface of the inkjet transparency is relatively less uniform and the coating typically contains more sites for light scattering and absorption. This is a common feature of many inkjet transparency films. The quantitative behavior of the signal 54 may be expected to vary from type to type of inkjet transparency films and between manufacturers, but it is quantitatively different than that of laser transparencies.

A white paper reflected signal curve 56 represents a sample detected signal received when the sheet 12 is a sheet of white paper. The paper signal 56 has normalized pixel values higher than both the laser transparency signal 52 and the inkjet transparency signal 54 because the paper 12, unlike the transparencies, reflects most of the incident light 45. Furthermore, the amount of transmitted light is significantly lower than any transparency film.

Various analyses can be performed on the signals from the transmitted and reflected light. For instance, the values can be analyzed to give mean value, range, standard deviation, and decomposed into frequency content by Fourier analysis. Further, multiple samples can be taken for further analysis such as average of multiple mean values, standard deviation of the multiple mean values, etc.

Figure 4:
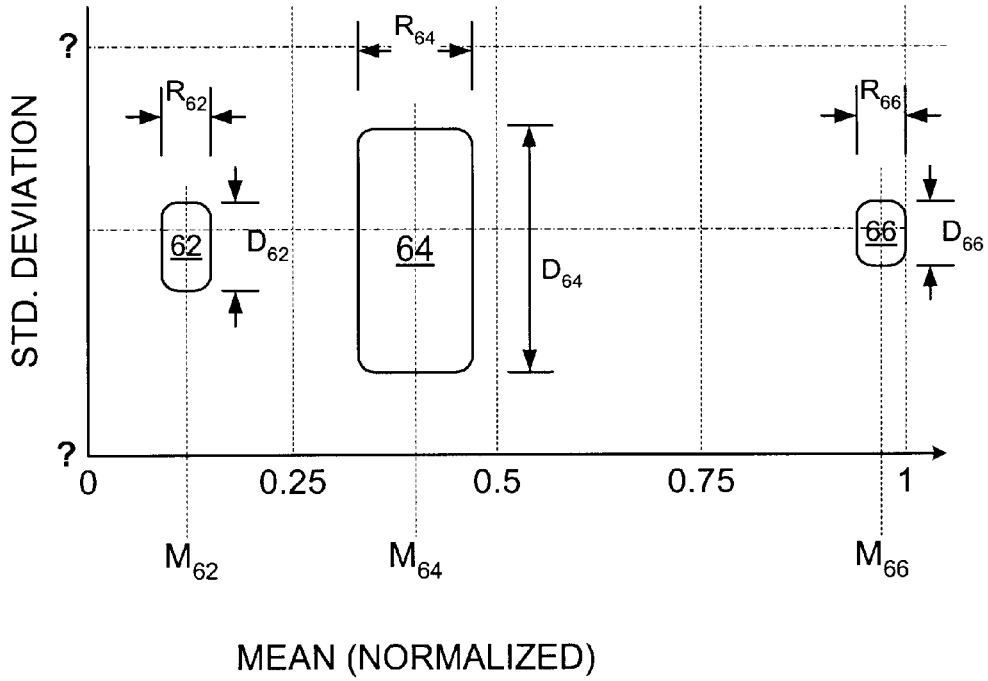
FIG. 4 illustrates sample metric criteria and profiles used to distinguish various media.

These values may be used as metric criteria to discriminate between laser transparency, inkjet transparency, or paper. FIG. 4 illustrates graphical representation of a few sample metric criteria areas, or profiles, that can be used for discrimination. Profile 62 schematically represents a cluster of the samples of the mean $M_{62}$, range $R_{62}$, and standard deviation $D_{62}$ of the laser transparency signal 52 of FIG. 3. This represents a particular type of laser transparency medium. Profile 64 schematically represents the mean $M_{64}$, range $R_{64}$, and standard deviation $D_{64}$ of the inkjet transparency signal 54 of FIG. 3. Profile 66 schematically represents the mean $M_{66}$, range $R_{66}$, and standard deviation $D_{66}$ of the paper signal 56 of FIG. 3.

Referring again to FIG. 1 and continuing to refer to FIG. 3, when the detected signal is received by the processor 28, the processor applies one of these criteria to determine whether the print medium is of an acceptable type. For example, the processor 28 calculates a profile of the print medium by determining the mean and the standard deviation of the detected signal. If the sheet 12 is an inkjet transparency, then these values (the mean and the standard deviation as the profile of the sheet 12) fall within or near Profile 64. In this case, to protect the fuser of the print mechanism 20, the processor 28 signals the feed mechanism 18 to halt feeding the sheet 12 toward the print mechanism 20. Alternatively, the processor 28 may signal the feed mechanism 20 to prevent it from heating or making contact with the sheet 12 as it passes through the print mechanism 20 toward the output tray 32. In any case, the processor 28 signals a display device 34 to display a status or an error message notifying an operator of the printer 10 that the sheet 12 is of incorrect type and will not be printed. For example, if an ink jet transparency film is detected in the paper path of a laser printer, the printer paper feed mechanism is immediately halted and a service message is presented to the user requiring the removal of the film. This presentation may be through the printer's control panel, by a message sent electronically through a network to a remote print server, or both.

Instructions for the processor 28 to apply the metric criteria to the detected signal are stored in storage 36. The storage 38, connected to the processor 28, also includes the metric criteria and profile information that can be accessed by the processor 28 for comparisons with the results of the signal analysis. This can be separate or integral to the printer's embedded control architecture.

In an alternative embodiment of the present invention, the processor 28 is programmed to allow the sheet 12 to proceed to the print mechanism 20 (or allow the print mechanism 20 to operate) only if certain metric criteria are met. For example, the processor 28 signals the print mechanism 20 to operate only when the detected signal analysis is within the criteria area 62 or area 66.

From the foregoing, it will be appreciated that the present invention is novel and offers advantages over the current art. Although a specific embodiment of the invention is described and illustrated above, the invention is not to be limited to the specific forms or arrangements of parts so described and illustrated. The invention is limited by the claims that follow.

What is claimed is:

1. A printer (10) having a transparency film discrimination system, the discrimination system comprising:

feed mechanism (18) for feeding a print medium (12) toward a print mechanism (20), the print medium (12)

being one of a plurality of different types, each type having a print surface (14);

illumination source (42) for providing light to impinge on the print surface (14);

detector (48) for detecting one of reflected and transmitted light from the print surface (14) to provide a detection signal representing the print surface (14) so as to allow identification of transparency type of the print medium (12); and processor (28) for applying metric criteria to the detected signal to identify type of transparency of the print medium (12) and for providing control to the print mechanism (20) dependent on the identified transparency type so that damage to the printer (10) is avoided.

2. The printer recited in claim 1 wherein the illumination source is arranged at a first angle from the normal to the surface of the print medium.

3. The printer recited in claim 2 wherein the first angle ranges from 0 degrees to 75 degrees.

4. The printer recited in claim 2 further comprising a second illumination source providing light impinging on the print surface normal to the print surface and wherein the first angle is between 30 and 75 degrees.

5. The printer recited in claim 1 wherein the detector is selected from a group consisting of a phototransistor, a photodiode, a CMOS sensor array, a light to frequency converter, and a light to voltage converter.

6. The printer recited in claim 1 wherein the detected light is converted to digital signal having digital value.

7. The printer recited in claim 1 further comprising storage, connected to the processor, having a profile of a acceptable type of print medium.

8. The printer recited in claim 1 wherein the processor compares profile of the print medium with the profile stored in the storage.

9. The printer recited in claim 1 wherein the processor is programmed to determine whether the detected signal has values what fall within predefined parameters.

10. A method of operating a printer, the method comprising:

feeding a print medium toward a print mechanism, the print medium being one of a plurality of different types, each type having a print surface;

illuminating the print surface of the print medium;

detecting one of reflected and transmitted light from the print surface to provide a detection signal representing the print surface so as to allow identification of transparency type of the print medium; and applying metric criteria to the detected signal to identify type of transparency of the print medium and for providing control to the print mechanism dependent on the identified transparency type so that damage to the printer is avoided.

11. The method recited in claim 10 wherein the metric criteria is comparison of mean and standard deviation of the signal representing the detected light compared to mean and standard deviation of a profile.

12. The method recited in claim 10 further comprising preventing operation of the print mechanism.

13. The method recited in claim 10 further comprising generating an error message.

14. A printer having a transparency film discrimination system, the discrimination system comprising:

feed mechanism for feeding, to a print mechanism, a transparency film medium having a print surface;

a first illumination source for providing light to transmit through the print medium;

a detector for detecting the transmitted light for providing a detection signal to a processor;

the processor, connected to the detector and to the feed mechanism, is programmed to apply a metric criteria to the detected signal to determine whether the print medium is of an acceptable type, and to signal the feed mechanism to reject print media of unacceptable type to prevent damage to the print mechanism.

15. The printer recited in claim 14 wherein the first illumination source is arranged at an angle with respect to the normal to the surface of the print medium.

16. The printer recited in claim 15 further comprising a second illumination source providing light impinging on the print surface normal to the print surface and wherein the first illumination source is arranged at angle between 30 and 75 degrees.

17. The printer recited in claim 14 wherein the detector is selected from a group consisting of a phototransistor, a photodiode, a CMOS sensor array, a light to frequency converter, and a light to voltage converter.

18. The printer recited in claim 14 wherein the detected light is converted to digital signal having digital value.

19. The printer recited in claim 14 further comprising storage, connected to the processor, having a profile of a correct type print medium.

20. The printer recited in claim 14 wherein the processor compares profile of the detected print medium with the profile stored in the storage.

21. The printer recited in claim 20 wherein the processor is programmed to determine whether the detected signal has values what fall within predefined parameters.

* * * * *